US007832578B1

(12) United States Patent
Willis et al.

(10) Patent No.: US 7,832,578 B1
(45) Date of Patent: Nov. 16, 2010

(54) STACKING FEATURE FOR A CHILD RESISTANT PUSH AND TURN CLOSURE AND CONTAINER COMBINATION

(75) Inventors: Clifton C. Willis, Evansville, IN (US); Mark K. Branson, Newburgh, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 1553 days.

(21) Appl. No.: 11/129,937

(22) Filed: May 16, 2005

(51) Int. Cl.
*B65D 41/06* (2006.01)
*B65D 55/02* (2006.01)

(52) U.S. Cl. ..... 215/222; 215/332

(58) Field of Classification Search ..... 215/222, 215/231, 332, 342, 349, 351, DIG. 1; 220/293
See application file for complete search history.

(56) References Cited

U.S. PATENT DOCUMENTS 2,072,873 A 3/1937 Fusting et al.
3,716,161 A 2/1973 Julian et al.
3,951,289 A * 4/1976 Landen ..... 215/211
4,153,172 A 5/1979 Bialobrzeski
4,353,474 A 10/1982 Luker
4,638,918 A 1/1987 Marzabal Martinez
5,988,412 A 11/1999 Minnette et al.
6,105,801 A 8/2000 Minnette
6,202,876 B1 * 3/2001 DeJonge ..... 220/217
6,695,160 B1 2/2004 Culley et al.

* cited by examiner

*Primary Examiner*—Anthony Stashick
*Assistant Examiner*—James N Smalley
(74) *Attorney, Agent, or Firm*—Chad D. Bruggeman; John F. Salazar; Middleton Reutlinger

(57) ABSTRACT

Complementary load bearing surfaces are provided on a child resistant closure and container combination forming at least one load carrying member preventing axial forces under stacking load conditions from causing biasing, child resistance, and/or seal failure when the closure is in a stacking position on the complimentary container.

14 Claims, 9 Drawing Sheets

STACKING FEATURE FOR A CHILD RESISTANT PUSH AND TURN CLOSURE AND CONTAINER COMBINATION

CROSS-REFERENCE TO RELATED APPLICATIONS

Not applicable

BACKGROUND OF THE INVENTION

1. Technical Field of the Invention

The present invention relates to a safety or child resistant closure and container combination providing a stacking feature. More particularly, the present invention relates to a safety closure and container combination, wherein the safety closure and the container are each provided with at least one axial aligning surface which cooperates to transmit a stacking load from the top wall of the closure to the neck of a container in order to prevent biasing, child resistance, seal failure and/or other failure or unintended seal breach under stacking load conditions.

2. Description of the Related Art

It is well known in the prior art to sealingly affix a safety closure upon the neck portion of a container. However, after containers are filled and closed for the first time, they are frequently packed in stacks in boxes for shipment or are displayed in stacks for marketing purposes. Such stacked loading of the containers and closures subjects the packages to large vertical or axial loads which can distort and permanently deflect the biasing means or spring (mechanical spring, spring liner, etc.), the seal, and/or the sidewall of the closures to a position in which only a rotating force is required to remove the closure from the container thereby destroying the child resistant feature. Additionally, unintended breach of seal can expose the contents of the closure to the ambient environment spilling or spoiling the contents therein.

When manufacturers mass-produce containers and closures containing drugs, food, drink, and the like, the containers are usually shipped to distributors and vendors, for public consumption. In order to prepare the containers for shipping, the containers are often stacked in an axial or vertical manner and placed in boxes or crates in a space saving configuration. Throughout shipping and storage of the containers, they remain in this vertical configuration for various periods of time. The extended storage times often result in large axial loads being placed on the container closures for a long period of time, which is often not factored into their design. As a result of stacking large loads for extended periods of time, sealing gaskets located within the closures rupture or become disfigured; springs or biasing means loose their flexibility; and/or closures become disfigured or distorted, in turn causing the loss of the child resistant feature, leakage, spoilage, or destruction of the substance stored therein. Even unintended breach of a seal can cause destruction of the substance stored therein. Such substances often include, for example, a liquid, dry powder, or a plurality of pills, capsules, tablets or the like.

Various inventions use a container with a single thread and a small pitch to bear a stacking load. However there are various disadvantages inherent with these structures. First, a container or closure having a small pitch necessarily has a small target area for engagably starting the closure threads on the container threads. Secondly, machines used for installation of screw on closures often turn closures at a rate of about 500 RPM. This speed in combination with a small target area can lead to manufacturing difficulties and stripped threads. Thirdly, such a configuration is limited to threaded container and closure combinations and is not applicable to other closure retaining designs such as bayonet lug retaining means.

In view of the deficiencies in the known container and closure combinations, it is apparent that a closure and container combination is needed having top load seal protection characteristics or stacking feature as well as having a closure which is easy to install on the closure.

SUMMARY OF THE INVENTION

The present invention overcomes many of the aforementioned problems associated with the prior art through the use of axially aligning surfaces. The present invention provides a safety closure and container combination in which a provision is made to absorb axial loads thereby permitting a closure and container combination to be stacked for extended periods of time and better retain their biasing means, seal, shape, and child resistant feature as well as remain in a stacked and sealed configuration. The closure of the instant invention may be referred to as a one-piece closure in that it is comprised of a single closure (i.e. no inner and outer shell), however it may several pieces such as a separate biasing means, seal, etc.

The safety feature or push and turn feature is comprised of a container neck outer surface or closure side wall inner surface having at least one lug-receiving recess while the other of the container neck outer surface or closure side wall inner surface has at least one lug projecting therefrom where the at least one lug being engageable with the at least one lug receiving recess when the closure reaches a sealing position on the container. A spring or biasing means cooperates with the closure top wall and lifts the lugs into the lug-receiving notches when the closure reaches a sealing position on the container and requires a simultaneous push and turn force to remove the closure from the container. The stacking feature of the present invention comprises at least one stacking lug depending outward from the container neck outer surface or depending inwardly from the closure inner surface. The stacking lugs axially align with a mating surface on the other of the container neck outer surface or closure inner surface when the closure is in a stacking position on said container. The mating surface that the stacking lug axially aligns with may be another stacking lug or a surface of the structure creating the lug-receiving recesses such as an existing surface of a bayonet lug. The stacking lugs and mating surfaces having complementary load bearing surfaces engageable with each other at a stacking position to resist axial displacement of the closure relative to the container and absorbing axial loads on said closure. This stacking feature may be incorporated with any existing one-piece thread or bayonet style safety closures and containers.

Additionally, the stacking feature can be combined with an on stop feature by having an "L" shaped lug on the container or closure. Optionally, the closure and container combination may incorporate a position retaining means such as detent(s) on the container neck or closure sidewall or rib(s) on a closure or container lug or thread.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION

The present invention is a child resistant safety closure which requires an axial force and simultaneous turning movement to remove the closure from a container and one which is provided with load bearing surfaces which prevent the axial deflection required for opening movement except when the cap is rotated to a position wherein the load bearing surfaces are out of axial alignment. The closure is referred to as a one-piece closure meaning that there is no inner and outer closure or shell. The one-piece closure may have several pieces such as a separate biasing means, seal, etc. The load bearing surfaces affording means of absorbing axial loads of the type encountered when containers are packed in quantity for shipment or are stacked for marketing displays. This top load seal protection or stacking feature of the present invention comprises lugs and mating surfaces formed on a container and/or closure which axially align and remove a downward force from the top gasket or seal and transfer it to the container when the closure is in a stacking position on the container. This ensures that there is little or no "play" between axially aligning lugs and maintains a substantially damage free seal or gasket and biasing means thereby maintaining seal integrity during shipping or storage and decreases the probability that the closure will become disengaged from the container.

Figure 1:
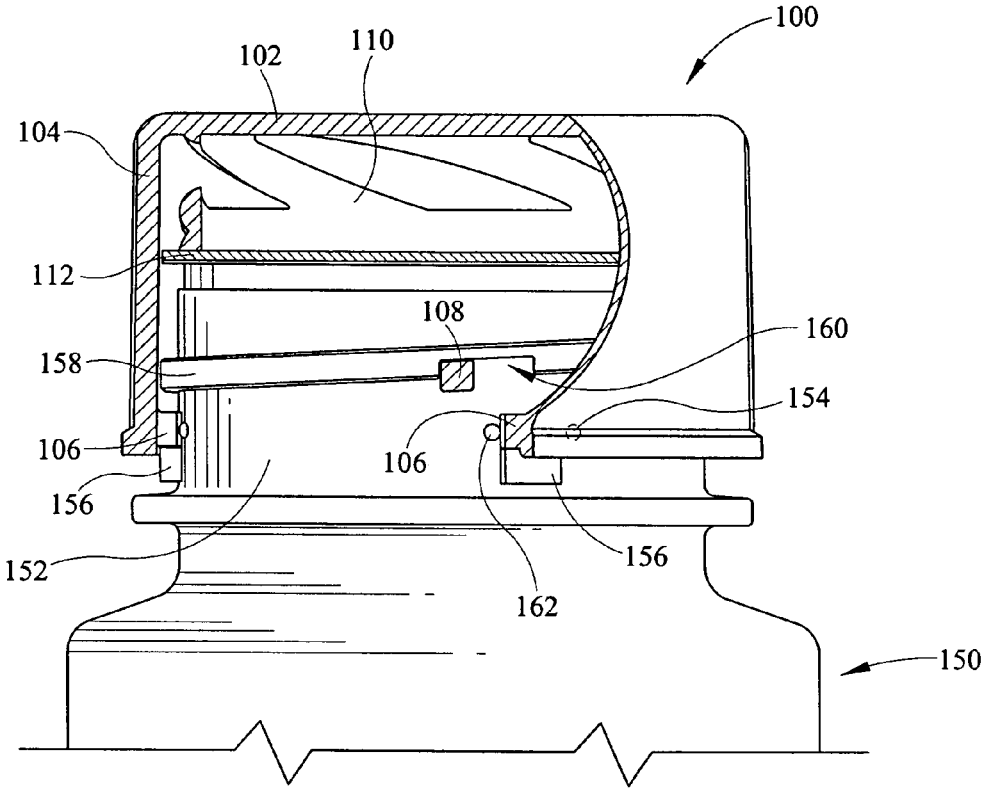
FIG. 1 is a side cutaway view of a screw type safety closure shown in spaced relation to a container neck portion having detents, the stacking feature in this embodiment comprises a solitary closure stacking lug and a solitary container stacking lug.

The present invention will now be described in conjunction with the figures, referring initially to FIG. 1, which shows a screw type safety closure 100 in spaced relation to a container neck portion 152. Closure 100 has top wall 102 having annular skirt or cylindrical depending side wall 104 depending therefrom, a plurality of lugs 108 along an inner surface of closure side wall 104 operably engage helically circumscribing container thread 158. Helically circumscribing container thread 158 has a plurality of lug receiving notches 160 that axially align with the plurality of closure lugs 108 providing a safety closure that requires simultaneously pushing and turning closure 100 to remove closure 100 from container 150. Depending from an inner surface of top wall 102 is biasing means 110 which cooperates with optional seal 112. Biasing means 102 may be a mechanical spring as shown, a springing liner, or other biasing means known by a person having ordinary skill in the art. When closure 100 is in a sealing position on container 150, biasing means 110 exerts a sealing force on seal 112 forming a seal between seal 112 and an upper rim of container neck 152. Seal 112 is preferably made of soft plastic, rubber-like or foam material which forms to the upper rim of container neck 152. Seal 112 seals contents from escaping between container 150 and closure 100. In addition, seal 112 may prevent air and other contaminants from entering the container 150 which may cause the contents to spoil.

The stacking feature of the present invention shown in this embodiment comprises closure stacking lug(s) 106 and container stacking lug(s) 156. There is at least one combination of stacking lugs 106 and 156 having mating surfaces that axially align when closure 100 nears a stacking position on container 150. Stacking lugs or load bearing protuberances 106 and 156 are preferably solitarily equidistantly spaced and integral with an inner surface of the annular skirt 104 and an outer surface of container neck 152 respectively. There are preferably three or four pairs of stacking lugs 106 and 156 which are preferably spaced about 120° or 90° apart, respectively. The circumferential length of closure lugs 108 are less than the circumferential length of lug receiving notches 160 by a distance of at least the circumferential length that stacking lugs 106 and 156 vertically align providing rotation of closure 100 disengaging stacking lugs 106 and 156 and allowing an axial and simultaneous rotational disengaging force to then disengage the child resistant feature. While closure 100 has stacking lugs 106 and 156 disengaged and the child resistant feature engaged (i.e. closure lugs 108 within lug receiving notches 160), closure 100 is still in a sealing position on container 150 even though it is not in a stacking position Also shown here are detents 154 and 162 extending outwardly from container neck 152 adjacent each side of closure stacking lug 106. When closure stacking lug 106 is in a sealing and stacking position on container neck 152, leading detent 162 and trailing detent 154 offer resistance to the rotation of closure 100 on container 150 resisting unwanted rotation of closure 100 and disengagement of stacking lugs 106 and 156 when shipping or stacking.

Closure 100 and container 150 using the stacking features of the present invention can be made of various materials such as plastics including polyethylene, polypropylene, metal and glass combinations, or other materials (i.e. other plastics), alone or in combination. The stacking lugs shown in the figures have substantially planar mating surfaces that align when closure 100 is in a stacking position on container 150. However, stacking lugs 106 and 156 may have "V" shaped, wavy, or other predefined contoured mating surfaces that axially align to provide a load transferring alignment. Also, lugs 106 and 156 are shown near the bottom of container neck 152 in this embodiment. However, lugs 106 and 156 may align anywhere on the axial length of container neck 152.

Figure 2:
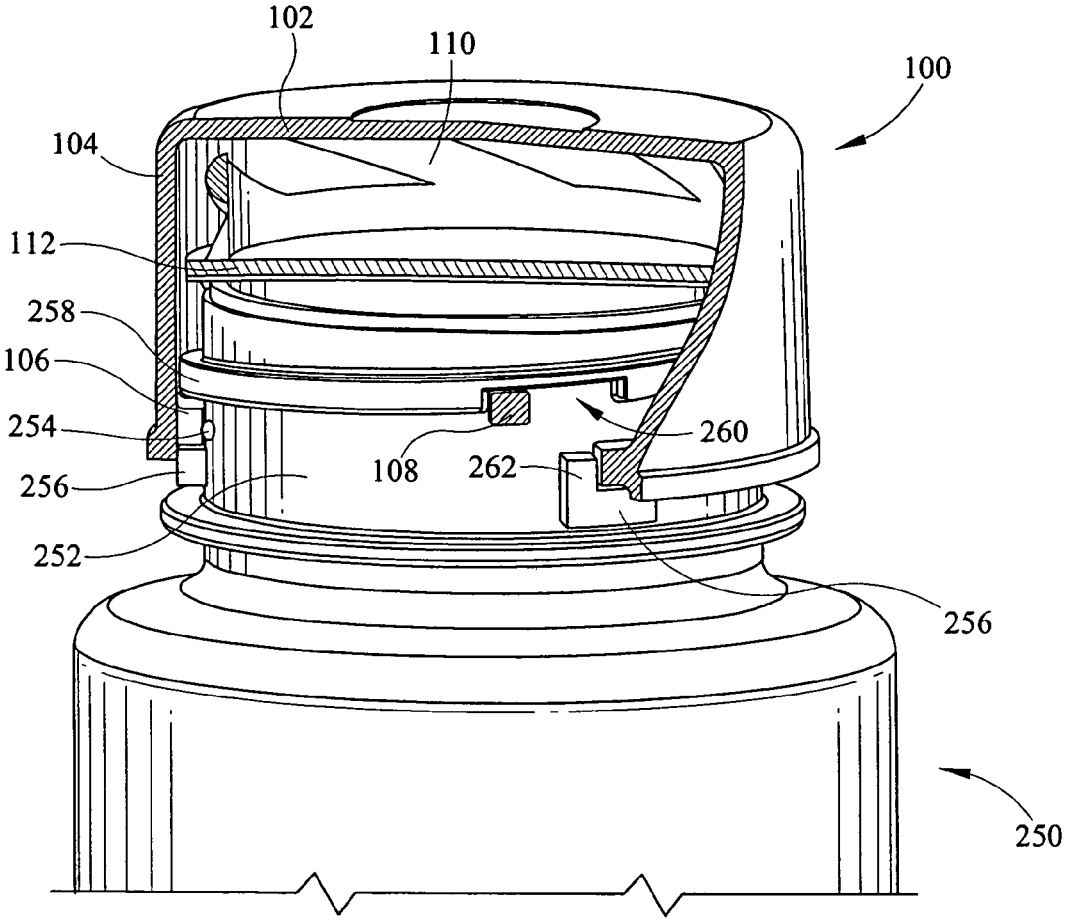
FIG. 2 is a perspective cutaway view of the safety closure of FIG. 1 shown in spaced relation to a container neck portion having detents and an on-stop feature depending from the container stacking lug.

FIG. 2 shows an alternative embodiment of a safety container 250 of the instant invention having optional on-stop lug 262. In this embodiment, closure 100, as shown in FIG. 1, is in a stacking position on container 250 having stacking lugs 256 and upward axially depending on-stops 262. On-stops 262 replace optional leading detents 162 on container 150 (FIG. 1) providing a greater resistance to a rotational on force placed on closure 100 when closure 100 is in a sealing and stacking position on container 250, thus reducing the tendency for lugs 108 to strip thread 258 under excessive rotational force. Optional trailing detent 254 radially depends from container neck 252 and provides resistance to a removing rotation of closure 100 while closure 100 is in a stacking position on container 250. The circumferential length of lugs 108 are less than the circumferential length of lug receiving notches 260 by a circumferential length to provide disengagement the mating surfaces of stacking lugs 256 and 106 while maintaining engagement of the child resistance feature, lugs 108 within lug receiving notches 260.

Figure 3:
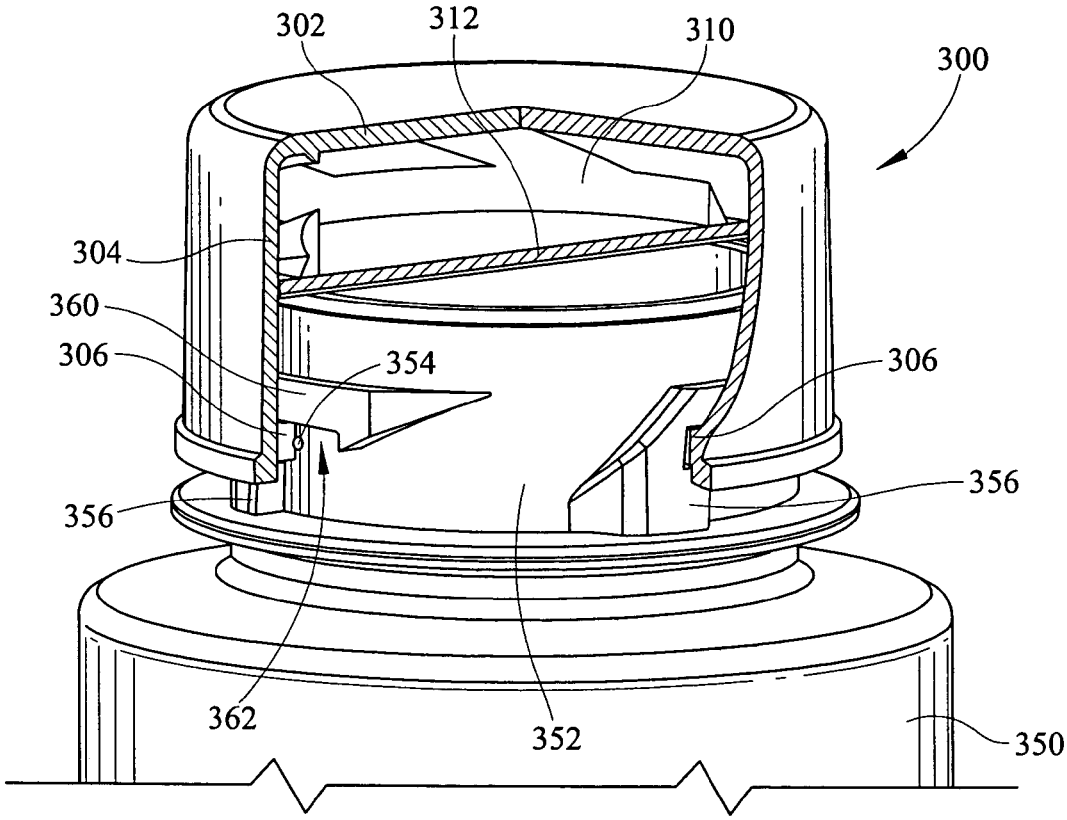
FIG. 3 is a perspective cutaway view of an alternative embodiment of a safety closure shown in spaced relation to a container neck portion having detents and bayonet lugs, the container neck has a stacking lug integral with the bayonet lug and the mating surface is a closure lug.

FIG. 3 shows another embodiment of the instant invention having safety closure 300 in a sealing position on container 350. Closure 300 has top wall 302 having annular skirt or depending side wall 304 depending therefrom, a plurality of closure lugs 306 along an inner surface of side wall 304 operably engage bayonet container lugs 360. When closure 300 reaches a sealing position on container 350, biasing means 310 exerts a sealing force on seal 312 forming a seal between seal 312 and an upper rim of container neck 352. In this embodiment, container 350 has detents 354 and bayonet lugs 360. The stacking feature on this embodiment includes container stacking lugs 356 depending outwardly from a lower edge of bayonet lugs 360 forming a bayonet lug receiving notch 362 having a lower partial enclosure. A bottom surface of closure lugs 306 provides a mating surface for container stacking lugs 356 and axially align with stacking lugs 356 when closure 300 is in a stacking position on container 350.

Container neck portion 352 includes at least one integrally-formed, radially-raised bayonet lug 360, and preferably, three or four bayonet lugs 360 annularly spaced, equidistantly around an outer perimeter of the neck portion 352. Each lug 306 is sized and shaped to be slidingly received within the lower partial enclosure of the bayonet lug receiving notch 362. The bayonet lug receiving notch 362 has a circumferential length sufficient for lug 306 to axially disengage container stacking lug 356. Detent 354 is optional and provides rotational resistance of closure 300 thereby decreasing rotational movement of closure 300 when the stacking feature is engaged (closure lugs 306 axially aligned above container stacking lugs 356).

Figure 4:
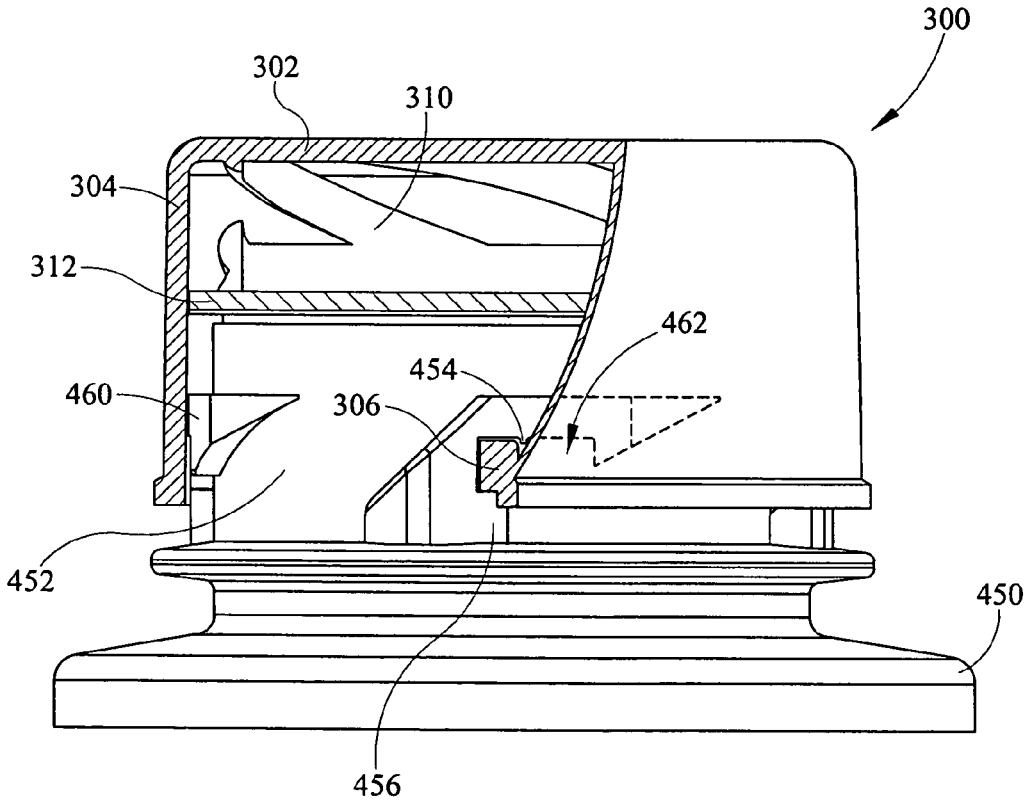
FIG. 4 is a side cutaway view of the safety closure of FIG. 3 shown in spaced relation to a container neck portion having a retention rib in the bayonet lugs, the container neck has a stacking lug integral with the bayonet lug and the mating surface is a closure lug.

FIG. 4 shows safety closure 300 of FIG. 3 spaced relation to container neck 452 of container 450. In this embodiment an optional rib or protuberance 454 extends downward from a top surface of lug receiving notch 462 in bayonet lug 460. Rib or protuberance 454 in bayonet lugs 460 provides rotational resistance of closure 300 thereby decreasing rotational movement of closure 300 when the stacking feature is engaged (closure lugs 306 have a bottom surface axially aligned with container stacking lugs 456).

Figure 5:
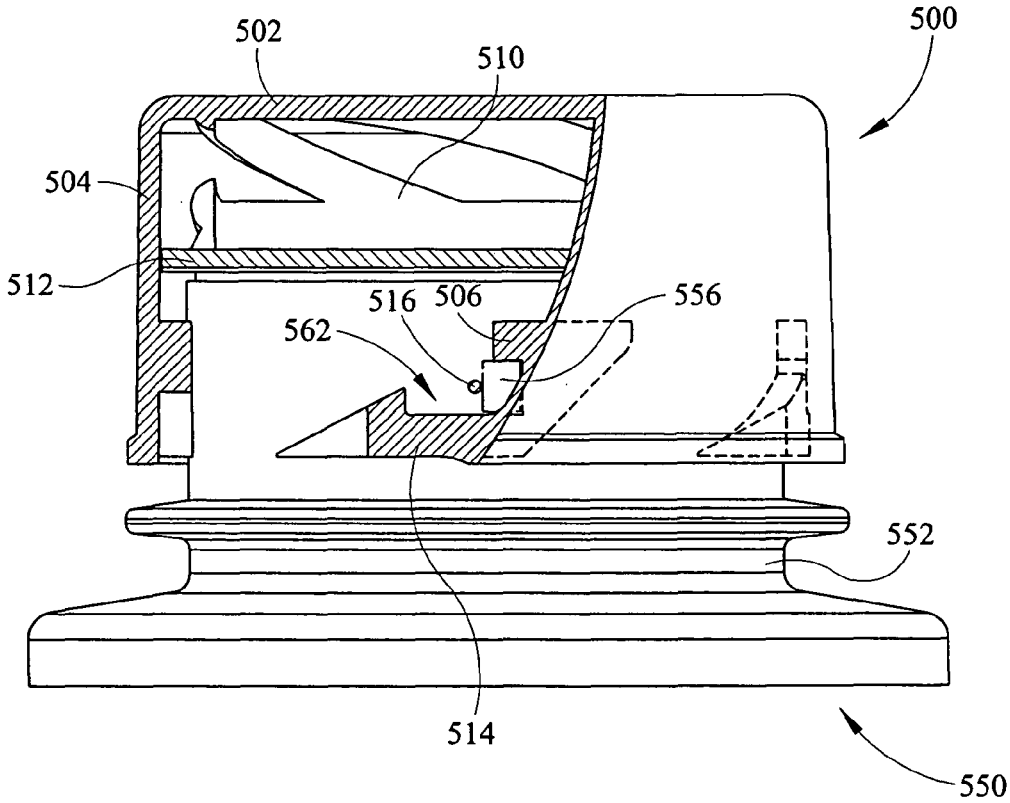
FIG. 5 is a side cutaway view of a safety closure having bayonet lugs and detents shown in spaced relation to a container neck portion, the stacking feature in this embodiment comprises a stacking lug integral with the bayonet lug and a mating surface on the container lug.

FIG. 5 shows safety closure 500 having bayonet lugs 514, detents 516, and closure stacking lugs 506 having a bottom mating surface in spaced relation to container neck portion 552 of container 550. Closure 500 has top wall 502 having annular skirt or side wall 504 depending therefrom. When closure 500 nears a sealing position on container 550, biasing means 510 exerts a sealing force on seal 512 forming a seal between seal 512 and an upper rim of container neck 552. Biasing means 510 may be a mechanical spring as shown or may be any biasing means known by one having ordinary skill in the art such as a springing liner. The stacking feature on this embodiment comprises closure stacking lugs 506 having a lower mating surface axially aligning with an upper mating surface of container lugs 556 when closure 500 is in a stacking position on container 550. Container lugs 556 depend outwardly from container neck portion 552 and operably engage bayonet lugs 516. Closure stacking lugs 506 are integral with bayonet lugs 514 forming a bayonet lug receiving notch 562 having an upper partial enclosure.

The inner surface of closure side wall 504 includes at least one integrally-formed, radially-raised bayonet lug 514, and preferably, three or four bayonet lugs 514 annularly spaced equidistantly around an inner perimeter of annular sidewall 504. Each container lug 556 is sized and shaped to be slidingly received within the partial enclosure of the bayonet lug receiving notch 562. The bayonet lug receiving notch 562 has a circumferential length sufficient for the mating surface of lug 556 to axially disengage container stacking lug 506. Detent 516 is optional and provides rotational resistance of closure 500 thereby decreasing rotational movement of closure 500 when the stacking feature is engaged (closure stacking lugs 506 axially aligned with container stacking lugs 556).

Figure 6:
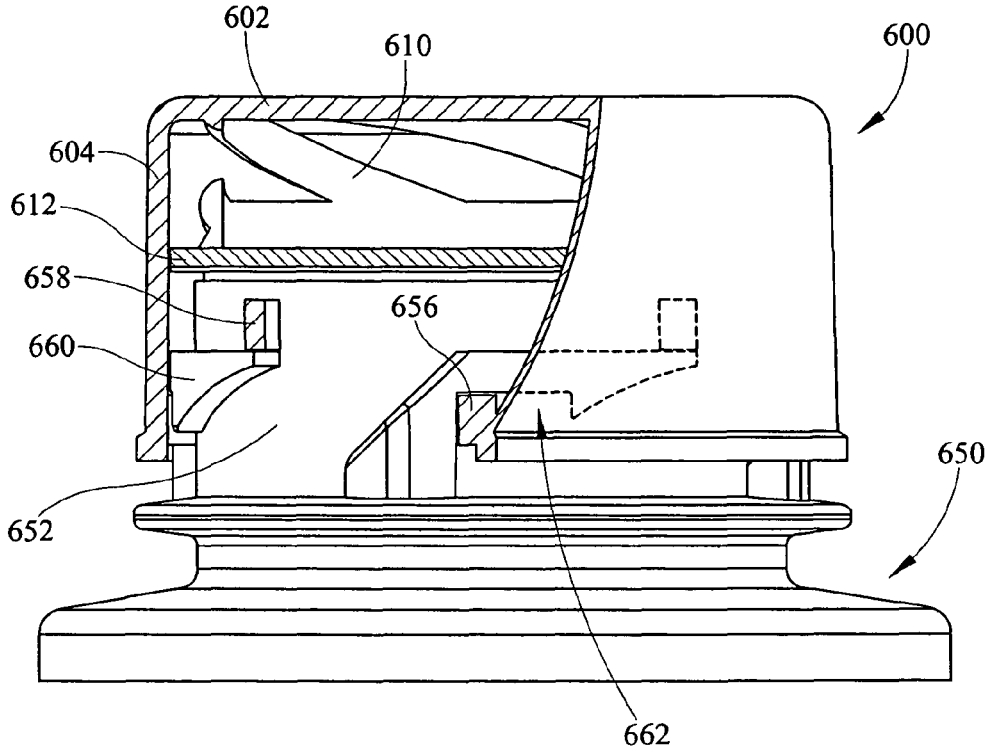
FIG. 6 is a side cutaway view of a safety closure shown in spaced relation to a container neck portion having bayonet lugs, the stacking feature in this embodiment comprises a solitary closure stacking and a mating surface on the bayonet lug.

FIG. 6 shows safety closure 600 in a sealing position on container 650. Closure 600 has top wall 602 having annular side wall 604 depending therefrom. When closure 600 nears a sealing position on container 650, biasing means 610 exerts a sealing force on seal 612 forming a seal between seal 612 and an upper rim of container neck 652. In this embodiment container 650 has bayonet lugs 660 receiving closure lugs 656. The stacking feature on this embodiment comprises closure stacking lugs 658 depending inwardly from the inner annular surface of closure sidewall 604 of closure 600.

The neck portion 652 includes at least one integrally-formed, radially-raised bayonet lug 660, and preferably, three or four bayonet lugs 660 annularly spaced equidistantly around an outer perimeter of the neck portion 652. Each closure stacking lug 658 has a lower mating surface oriented with respect to closure lugs 656 and bayonet lugs 660 so that when container lugs 656 are slidingly received within bayonet lug receiving notches 662, closure stacking lugs 658 have a lower mating surface axially aligning with an upper mating surface of bayonet lugs 660. The bayonet lug receiving notch 662 has a circumferential length in excess of the circumferential length of closure lug 656 sufficient for the mating surface of stacking lug 658 to axially disengage the upper mating surface of bayonet lug 660.

Figure 7:
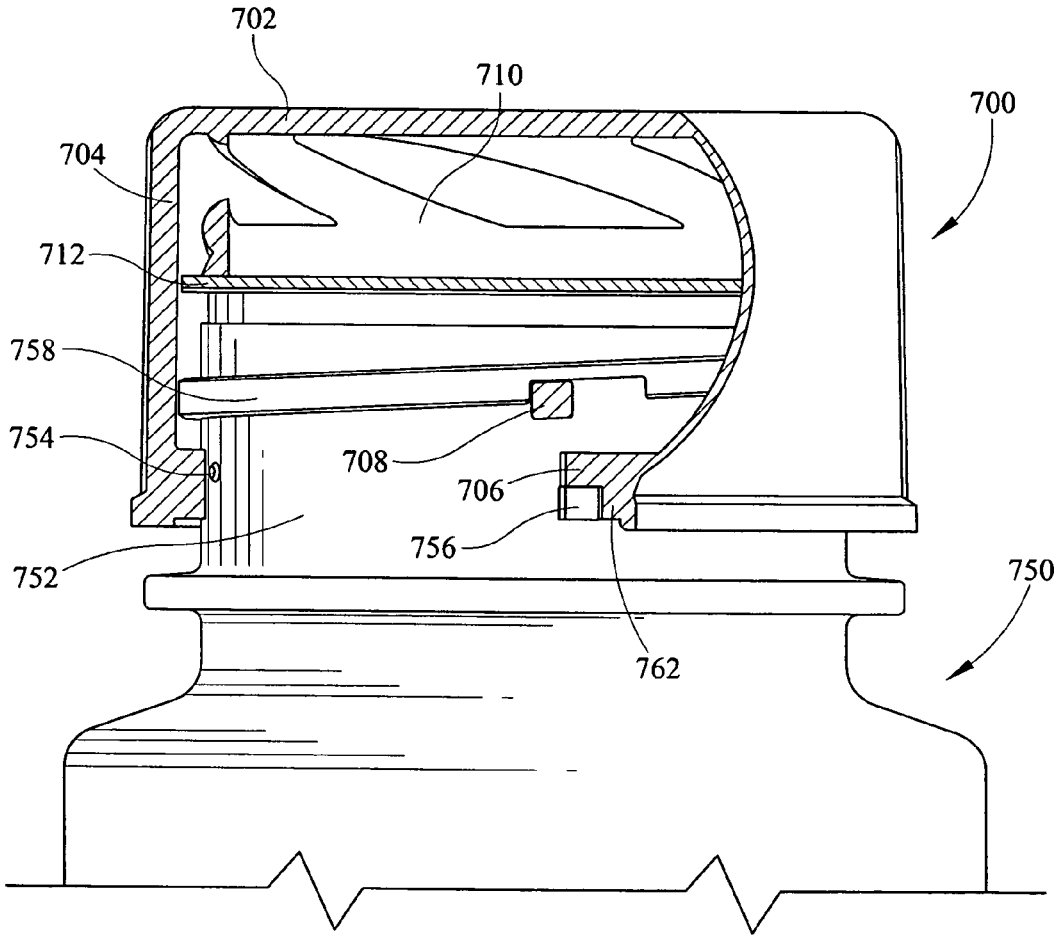
FIG. 7 is a side cutaway view of a safety closure having an on-stop feature on the closure shown in spaced relation to a container neck portion having detents, the stacking feature in this embodiment comprises a closure stacking lug with integral on-stop lug and a solitary container stacking lug.

FIG. 7 shows safety closure 750 of the instant invention having on-stop feature 762. Closure 700 has top wall 702 having cylindrical side wall 704 depending therefrom. When closure 700 nears a sealing position on container 750, biasing means 710 exerts a sealing force on seal 712 forming a seal between seal 712 and an upper rim of container neck 752. In this embodiment, closure 700 is in a sealing position on container 750 having container stacking lugs 756 axially aligned with closure stacking lugs 706. Downwardly depending from closure stacking lugs 706 are on-stop lugs 762. On-stops lugs 762 provide a resistance to a rotational on force placed on closure 700 when closure 700 is in a stacking position on container 750, thus reducing the tendency for closure lugs 708 to strip thread 758 under an excessive rotational force. When closure 700 is in a stacking position on container 750, trailing detent 754 offer resistance to the rotation of closure 700 on container 750 resisting unwanted rotation of closure 700 and disengagement of the mating surfaces of stacking lugs 706 and 756 when shipping or stacking.

Figure 8:
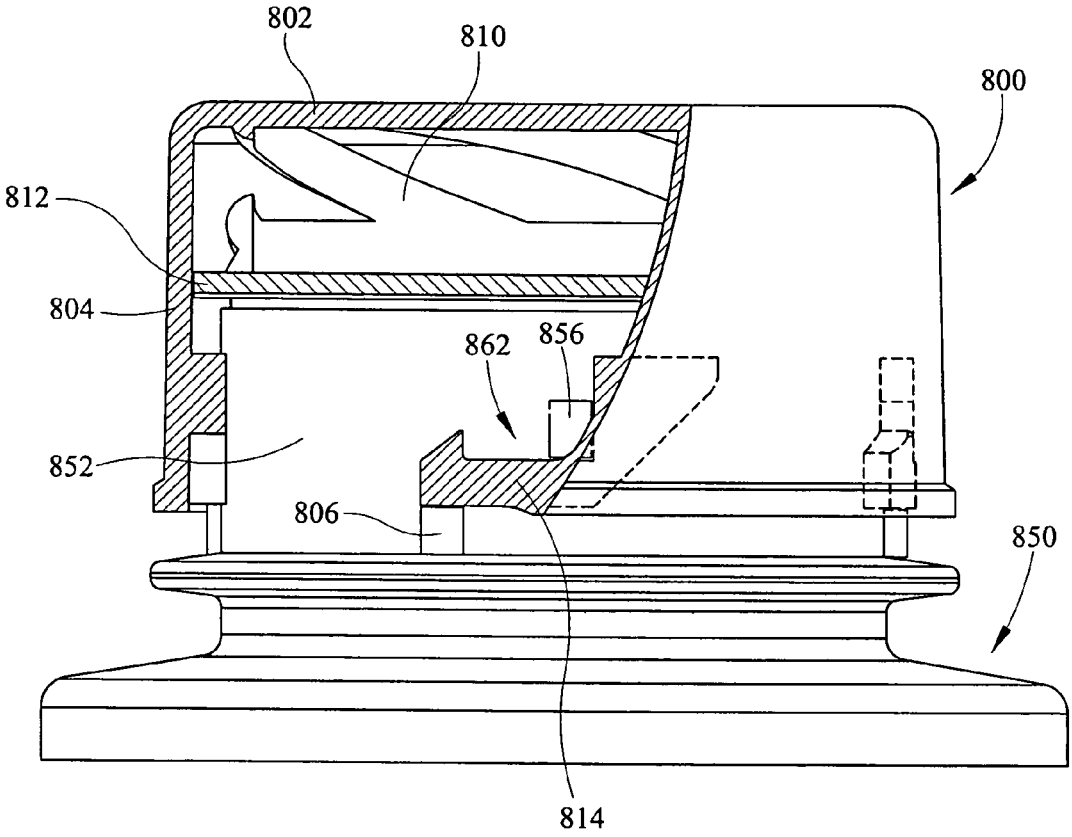
FIG. 8 is a side cutaway view of a safety closure having bayonet lugs shown in spaced relation to a container neck portion, the stacking feature according to this embodiment comprises a solitary container stacking lug and a mating surface on the bayonet lug.

FIG. 8 shows safety closure 800 having bayonet lugs 814 in spaced relation on container neck portion 852 of container 850. Closure 800 has top wall 802 having side wall 804 depending therefrom. The stacking feature in this embodiment comprises container stacking lugs 806 depending outwardly from container neck portion 852. Container stacking lugs 806 are integral with container neck 852 and having an upper mating surface that axially aligns with a lower mating surface of bayonet lugs 814 when in a stacking position. The inside surface of side wall 804 of closure 800 includes at least one integrally-formed, bayonet lug 814, and preferably, three or four bayonet lugs 814 annularly spaced equidistantly around an inner perimeter of annular sidewall 804. Each container lug 856 is sized and shaped to be slidingly received within bayonet lug receiving notches 862. Bayonet lug receiving notch 862 has a circumferential length sufficient for the mating surface of container stacking lug 806 to axially disengage the mating surface of container bayonet lug 814. A detent or rib in bayonet lug receiving notch 862 could optionally provide a rotational resistance of closure 800 thereby decreasing rotational movement of closure 800 when the stacking feature is engaged (container stacking lug 806 axially aligned with a lower mating surface on bayonet lugs 814).

Figure 9:
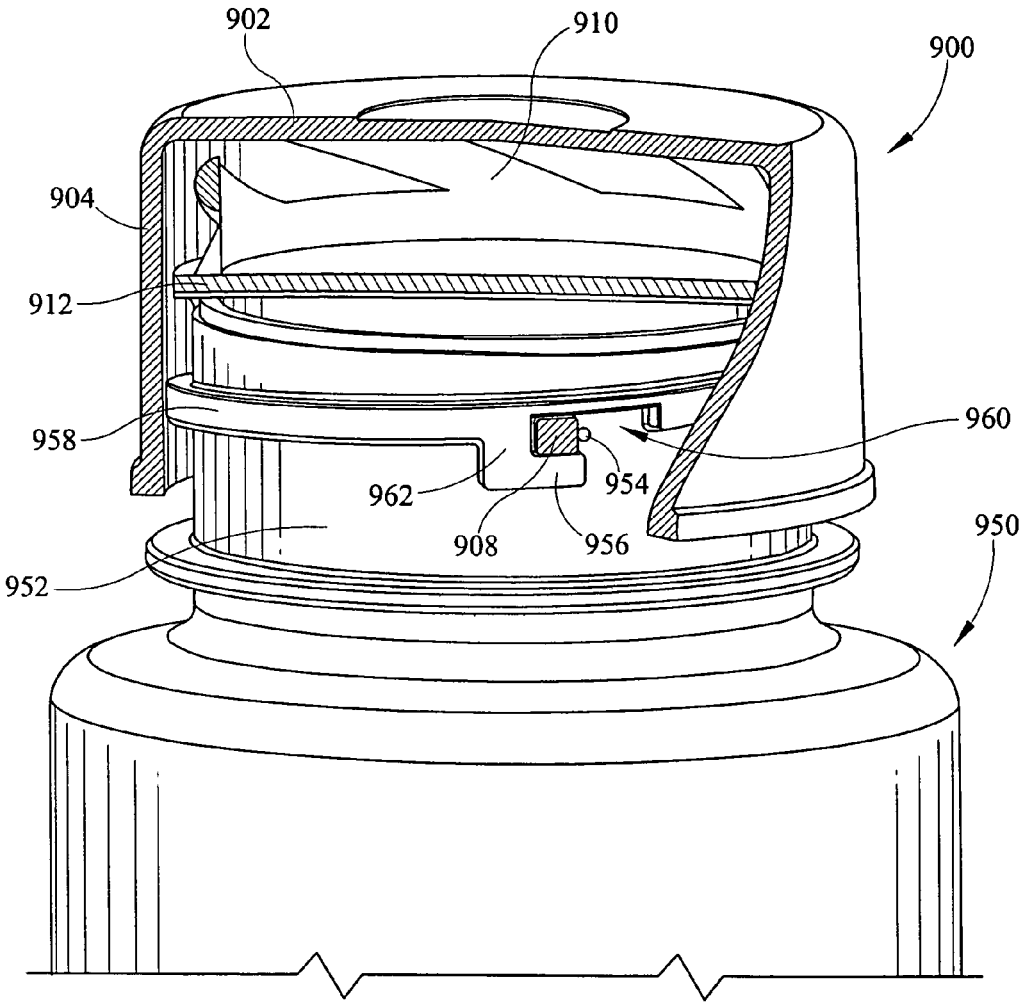
FIG. 9 is a perspective cutaway view of a screw type safety closure and container combination where the container neck portion has detents, an on-stop lug integral with a notch in a helical thread and a stacking lug integral with the on-stop lug, the mating surface for the stacking lug is a closure lug.

FIG. 9 shows a screw type safety closure 900 in spaced relation to a container neck portion 952 having detents 954. Closure 900 has top wall 902 having annular side wall 904 depending therefrom, a plurality of closure lugs 908 along an inner surface of annular side wall 904 operably engage helically circumscribing container thread 958. Helically circumscribing container thread 958 has a plurality of lug receiving notches 960 that axially align with the plurality of closure lugs 908 providing a safety closure that requires simultaneously pushing and turning closure 900 to remove closure 900 from container 950. Depending from an inner surface of top wall 902 is biasing means 910 which cooperates with optional seal 912. When closure 900 nears a sealing position on container 950, biasing means 910 exerts a sealing force on seal 912 forming a seal between seal 912 and an upper rim of container neck 952. The stacking feature in this embodiment comprises container stacking lugs 956 having an upper mating surface axially aligning with a lower mating surface on container lugs 908 when closure 900 is in a stacking position on container 950. Also shown here are optional detents 954 extending outwardly from container neck 952 in lug receiving notches 960. When closure lugs 908 are in a stacking position or axially aligned with stacking lugs 956, detents 954 offer a slight resistance to the rotation of closure 900 on container 950 resisting unwanted rotation of closure 900 and disengagement of lugs 908 and 956. On-stop lugs 962 are optional and are shown to be integral with thread 958 and stacking lugs 956. On-stop lugs 962 provide a greater resistance to a rotational on force placed on closure 900 when closure 900 is in a stacking position on container 950, thus reducing the tendency for lugs 908 to strip thread 958 under excessive rotational force.

The present invention provides complementary load bearing surfaces on a child resistant closure and container combination that axially align when the closure nears an on position on the complimentary closure. The load bearing surfaces are provided for a variety of child resistant closure and container combinations such as those incorporating a helical thread, square lug, bayonet lug, or other engaging means between a closure and container known by persons having ordinary skill in the art. The axially aligning surfaces form at least one load carrying member reducing the tendency for axial forces under stacking load conditions to cause biasing, child resistance, seal failure, and/or other stacking related failure when the closure is in a stacking position on the complimentary container.

The invention claimed is:

1. A push and turn safety closure and container combination, comprising:

a container having a depending substantially cylindrical container neck with an outer surface;

a closure having a substantially round top wall and a depending substantially cylindrical side wall with an inner surface;

said container neck outer surface having at least one lug receiving recess therein, said at least one lug receiving recess defined by a bottom surface connecting two opposing lateral interior surfaces that face inwardly towards each other, said at least one lug receiving recess having a first circumferential length between said two opposing lateral interior surfaces;

said closure side wall inner surface having at least one lug projecting therefrom of a second circumferential length, said at least one lug being engageable with said at least one lug receiving recess;

a spring member to bias said closure away from said container neck; and at least one stacking lug depending outward from said container neck outer surface or depending inwardly from said closure inner surface;

said closure is in a stacking position when said at least one lug engages said bottom surface of said at least one lug receiving recess and said at least one stacking lug having a mating surface axially aligning with and engages a mating surface on the other of said container neck outer surface or said closure inner surface thereby substantially preventing axial movement of said closure in both upwardly and downwardly directions while in said stacking position relative to said container and absorbing axial loads on said closure;

said mating surface of said at least one stacking lug having a third circumferential length;

said first circumferential length of said at least one lug receiving recess being at least the sum of said second and said third circumferential lengths thereby allowing said at least one lug to laterally disengage from said stacking position while remaining within said at least one lug receiving recess.

2. The safety closure and container combination of claim 1 wherein said spring member is a mechanical spring depending from said top wall of said closure.

3. The safety closure and container combination of claim 1 wherein said spring member is a springing liner.

4. The safety closure and container combination of claim 1 wherein said mating surface is a stacking lug on the other of said container neck outer surface or said closure inner surface.

5. The safety closure and container combination of claim 1 wherein said mating surface is a surface on said at least one lug.

6. The safety closure and container combination of claim 1 wherein said mating surface is a surface on at least one bayonet lug having a notch therein forming said at least one lug-receiving recess.

7. The safety closure and container combination of claim 1 wherein said at least one lug-receiving recess is formed with a helical thread having at least one notch therein.

8. The safety closure and container combination of claim 1 wherein said at least one lug-receiving recess is formed within at least one bayonet lug.

9. The safety closure and container combination of claim 8 wherein said at least one bayonet lug is on said container neck outer surface, said at least one stacking lug depending outwardly from a lower edge of said at least one bayonet lug forming a bayonet lug receiving notch having a lower partial enclosure.

10. The safety closure and container combination of claim 8 wherein said at least one bayonet lug is on said container neck outer surface, each of said at least one stacking lug depend inwardly from said closure inner surface and are axially aligned with an upper mating surface of said at least one bayonet lug when said closure is in said stacking position on said container.

11. The safety closure and container combination of claim 1 wherein said container neck outer surface or said closure inner surface has a detent adjacent a trailing edge of said at least one lug or stacking lug on the other of said container neck outer surface or said closure inner surface when said closure is in said stacking position on said container causing resistance to a removing rotation of said closure from said container.

12. The safety closure and container combination of claim 8 wherein said at least one bayonet lug has a rib extending from said bayonet lug axially into said lug receiving notch adjacent a trailing edge of said at least one lug on said closure side wall inner surface when said closure is in said stacking position on said container causing resistance to a removing rotation of said closure from said container.

13. The safety closure and container combination of claim 1 wherein said a container neck outer surface or said closure inner surface has an on stop lug adjacent a leading edge of said at least one lug or said at least one stacking lug on the other of said container neck outer surface or said closure inner surface when said closure is in said stacking position on said container.

14. A push and turn safety closure and container combination comprising:

a container having a container neck, said container neck having an opening defined by an upper rim;

a plurality of bayonet lugs annularly positioned around an outer perimeter of said container neck, each of said bayonet lugs having a receiving notch and a bottom cam surface, where said bottom cam surface is adjacent said receiving notch, said receiving notch defined as a bottom surface of said bayonet lug connecting two opposing lateral interior surfaces that face inwardly towards each other, said bottom surface having a first circumferential length between said two opposing lateral interior surfaces;

a stacking lug projecting from said container neck beneath each of said bayonet lugs, said stacking lug axially positioned in vertical alignment with a portion of said bottom surface of said receiving notch, whereby said stacking lug has a top mating surface, said top mating surface having a second circumferential length and spaced at a first axial distance from said notch bottom surface of said bayonet lug;

a closure having a top wall with a depending annular side wall, a spring member projecting from said closure top wall to bias said closure away from said container neck, said annular side wall having an inner surface;

a plurality of closure lugs annularly positioned about said inner surface of said annular side wall and similarly spaced from said closure top wall;

each said closure lug having a vertical height substantially the same as said first axial distance between said notch bottom surface of said bayonet lug and said top mating surface of said stacking lug;

each of said closure lugs having a bottom mating surface, said bottom mating surface having a third circumferential length;

said first circumferential length being at least the sum of said second circumferential length and said third circumferential length; and said bottom mating surface of each of said closure lugs axially align with said top mating surface of each of said stacking lugs when said closure is in a stacking position relative to said container.

* * * * *

UNITED STATES PATENT AND TRADEMARK OFFICE

CERTIFICATE OF CORRECTION

PATENT NO. : 7,832,578 B1
APPLICATION NO. : 11/129937
DATED : November 16, 2010
INVENTOR(S) : Clifton C. Willis et al.

It is certified that error appears in the above-identified patent and that said Letters Patent is hereby corrected as shown below:

Column 2, Line 20: insert --be-- after "may"
Column 5, Lines 18 and 19: insert --of-- after "disengagement"
Column 6, Line 11: replace "516" with --514--
Column 6, Line 44: replace "container" with --closure--
Column 6, Line 62: replace "On-stops" with --On-stop--
Column 6, Line 67: replace "offer" with --offers--
Column 7, Line 5: replace "on" with --to--
Column 7, Line 21: replace "container" with --closure--
Column 7, Line 45: replace "container" with --closure--
Column 9, Line 33: delete "a" after "wherein said"

Signed and Sealed this
Nineteenth Day of February, 2013

Teresa Stanek Rea
*Acting Director of the United States Patent and Trademark Office*